US007251342B2

(12) United States Patent
Graebener

(10) Patent No.: US 7,251,342 B2
(45) **Date of Patent: *Jul. 31, 2007**

(54) SINGLE END PLANAR MAGNETIC SPEAKER

(75) Inventor: David Graebener, Carson City, NV (US)

(73) Assignee: American Technology Corporation, San Diego, CA (US)

( * ) Notice: Subject to any disclaimer, the term of this patent is extended or adjusted under 35 U.S.C. 154(b) by 104 days.

This patent is subject to a terminal disclaimer.

(21) Appl. No.: 10/169,218

(22) PCT Filed: Mar. 2, 2001

(86) PCT No.: PCT/US01/06694

§ 371 (c)(1),
(2), (4) Date: Oct. 31, 2002

(87) PCT Pub. No.: WO01/67812

PCT Pub. Date: Sep. 13, 2001

(65) Prior Publication Data

US 2003/0228029 A1 Dec. 11, 2003

(51) Int. Cl.
*H04R 7/04* (2006.01)
*H04R 9/06* (2006.01)

(52) U.S. Cl. ..... 381/431; 381/421

(58) Field of Classification Search ..... 381/113, 381/116, 152, 174, 176, 190, 191, 399, 412, 381/423, 426, 427, 428; 181/167, 168, 169, 181/170, 173, 174

See application file for complete search history.

(56) References Cited

U.S. PATENT DOCUMENTS 3,013,905 A 12/1961 Gamzon et al.
3,141,071 A 7/1964 Rich (Continued)

FOREIGN PATENT DOCUMENTS

JP 06-181598 * 6/1994
WO WO 00/41492 7/2000

OTHER PUBLICATIONS

"Standard Specifications for Permanent Magnet Materials", 1964, Magnetic Materials Producers Assoication, MMPA Standard No. 0100-00, p. 18.*

*Primary Examiner*—Sinh Tran
*Assistant Examiner*—Brian Ensey
(74) *Attorney, Agent, or Firm*—Thorpe North & Western LLP

(57) ABSTRACT

A single end planar magnetic speaker system having at least one thin film, flexible diaphragm (72, 90) having a front side and a rear side for converting an input electrical signal into a corresponding acoustic output, the at least one diaphragm including a predetermined conductive region (76) and a predetermined non-conductive region; a magnetic structure (92) utilizing nonferite high energy magnets of a predetermined thickness wherein the magnets are each at least as wide as they are deep; the magnets having a magnetic strength wherein when compared to magnets of a ferrite type of same width as the nonferite high energy magnets but which have increased depth to yield at least nearly the same magnetic strength as the high energy magnets in the magnetic structure, doubling the depth of the high energy magnets in the magnetic structure, doubling the depth of the high energy magnets in the magnetic structure yields an increase in speaker sensitivity of at least 3 dB while the doubling the depth of the ferrite type magnet will yield a gain of less than 3 dB, and the system further includes a mounting structure coupled to the diaphragm to capture the diaphragm, to hold it in a predetermined state of tension and space it at a predetermined distance from the magnetic structure.

19 Claims, 8 Drawing Sheets

U.S. PATENT DOCUMENTS 3,209,084 A 9/1965 Gamzon et al.
3,674,946 A 7/1972 Winey
3,829,623 A 8/1974 Willis et al.
3,873,784 A 3/1975 Doschek
3,919,499 A 11/1975 Winey
3,922,504 A 11/1975 Kishikawa et al.
3,941,946 A 3/1976 Kawakami et al.
3,997,739 A 12/1976 Kishikawa et al.
4,156,801 A 5/1979 Whelan et al.
4,210,786 A 7/1980 Winey
4,242,541 A 12/1980 Ando
4,338,489 A 7/1982 Gorike
4,468,530 A 8/1984 Torgeson
4,471,172 A 9/1984 Winey
4,480,155 A 10/1984 Winey
4,550,228 A 10/1985 Walker et al.
4,703,509 A 10/1987 Kanchev
4,803,733 A 2/1989 Carver et al.
4,837,838 A 6/1989 Thigpen et al.
4,939,784 A 7/1990 Bruney
5,003,609 A 3/1991 Muraoka
5,003,610 A 3/1991 Adachi et al.
5,021,613 A 6/1991 Garcia
5,283,836 A * 2/1994 Trufitt ..... 381/428
5,297,214 A 3/1994 Bruney
5,430,804 A 7/1995 Stevenson et al.
5,430,805 A 7/1995 Stevenson et al.
5,684,884 A 11/1997 Nakaya et al.
5,850,461 A 12/1998 Zelinka
5,901,235 A 5/1999 Thigpen et al.
5,953,438 A 9/1999 Stevenson et al.
5,961,762 A 10/1999 Zelinka et al.
6,104,825 A 8/2000 Thigpen
6,137,891 A 10/2000 Porrazzo et al.
6,154,557 A 11/2000 Montour et al.
6,188,775 B1 * 2/2001 Azima et al. ..... 381/423

* cited by examiner

SINGLE END PLANAR MAGNETIC SPEAKER

FIELD OF THE INVENTION

This invention relates to planar magnetic speakers, and in particular to single end planar magnetic speakers capable of audio output least within the mid and upper audio frequency ranges, and preferably within the full audio range.

PRIOR ART

Two general types of loudspeakers comprise (i) dynamic and (ii) electrostatic. A third loudspeaker type representing a more limited area of acoustic reproduction is the planar magnetic speaker. It represents a bridging technology between the dynamic and electrostatic speaker designs; however, it has not achieved any significant level of market acceptance over the past 65 years of evolution. Indeed, planar magnetic speakers comprise much less than one percent of an audio speaker industry. It is clearly a field of acoustic technology which has remained exploratory.

As with any speaker, competitive issues are controlling. In addition to quality, a truly competitive speaker must be reasonable in price, practical in size and weight, and predictable in performance. Assuming that two different speakers provide comparable audio output, the deciding factors in realizing a successful market will be price, convenience and aesthetic appearance. Price is obviously a function of materials and cost of assembly. Convenience embodies considerations of how the speaker will be used, such as mobility, weight, size, and location. Finally, the aesthetic aspects of the speaker will be of consumer interest, including considerations of decor, size, and cosmetic appearance in relation to the surroundings.

It is interesting to note that the general field of planar magnetic speakers has evolved around two basic categories. The first and dominant category is referred to a double ended or push-pull system and is illustrated in FIG. 1. This structure is characterized by two magnet arrays 20 and 21 positioned on opposite sides of a flexible diaphragm 22 which includes a conductive coil 23 positioned thereon. The film is tensioned into a planar configuration by a mounting structure 24. An audio signal is supplied to the coil 23 to provide a variable voltage which interacts with a fixed magnetic field between the magnet arrays 20 and 21. The diaphragm is displaced by a resulting force in accordance with the frequency and amplitude of an audio signal, thereby generating desired acoustic output. Obviously, the greatest displacement of the diaphragm will occur in the densest portions of the magnetic field proximate to the magnetic field proximate to the magnets.

Historically, ceramic magnets have been applied as the magnetic material comprising a respective magnet array 20 and 21. Typically, common poles are juxtaposed, resulting in strong repulsion forces which tend to drive the respective sides of the push-pull system apart. This structure necessitates the use of complex and mechanically challenging design requirements to keep the opposing magnets properly positioned. This constant force can easily disrupt long term performance of the speaker by causing gradual shifting of mechanical structure within the speaker. This, again, increases manufacturing costs necessary to counteract this destructive displacement.

Additional problems which require attention involve tunneling of sound and diffusion of certain bandwidths. For example, gaps 26 between the magnet elements form tunnels

26 from the diaphragm to the outside environment which change frequency response of the emitted signal. This also causes high frequency problems of peaks and premature attenuation. Other problems are well known in the industry, and include issues set forth in the following patents which are incorporated by reference.

| | | |
|---|---|---|
| 5,901,235 | Thigpen, et al. | May 4, 1999 |
| 5,850,461 | Zelinka | Dec. 15, 1998 |
| 3,922,504 | Kishikawa et al. | Nov. 25, 1975 |
| 3,997,739 | Kishikawa et al. | Dec. 14, 1976 |
| 5,021,613 | Garcia | Jun. 4, 1991 |
| 4,803,733 | Carver et al. | Feb. 7, 1989 |
| 4,156,801 | Whelan et al. | May 29, 1979 |
| 3,141,071 | Rich | Jul. 14, 1964 |

The second category of planar magnetic speakers comprises single end devices. FIG. 2 illustrates a typical single end speaker having a flexible diaphragm 30 with conductive region 31. The diaphragm is tensioned and supported by a frame member 32. A single array of magnets 33 is positioned next to the diaphragm and provides a fixed magnetic field with respect to the conductive region or coil 31. It is apparent that the single array of magnets (typically of ceramic composition) provides a much reduced energy field. Because of this, single end devices have not been acceptable for commercial applications. Attempts to increase power output by doubling the size of the ceramic magnets 33*a* (see FIG. 3) have generally failed to yield any significant improvement. In fact, the increased magnet size results in deeper channels or tunnels 36, further complicating the design of the speaker. This lack of increased power based on increasing the thickness of the magnets has apparently been an accepted perception within the industry over the past 65 years. It has apparently discouraged efforts to focus on redesign of the magnet array in a single end system, and has led the industry to depend upon increasing the number and density of magnets instead of increasing thicknesses.

As a result of the perception that increasing magnet thickness is not a practical approach for enhancing power, single end devices are generally characterized by large size and comparatively low efficiency. For example, single end speakers are usually greater than three feet in diameter and rely on a large diaphragm surface area with very small displacement. Total surface area is in the range of approximately 200 to 800 square inches. From another perspective, the surface area of conventional single end speakers is generally on the order of ten times the surface area of a conventional dynamic speaker to be competitive in output. Theoretically, the low efficiency of this single end system requires large surface area in order to achieve the necessary displacement of air volume. This large size imposes significant strain on production requirements and long term performance.

The difficulties of manufacturing by cost effective methods is particularly troublesome with large planar magnetic structures, as it is with large electrostatic speakers. Failure to maintain uniform alignment of the diaphragm with respect to the driving magnetic field is a major problem. The variation in flux density as a function of distance from the fixed magnets is nonlinear. Therefore, slight deviations from proper positioning can result in serious aberrations in acoustic output. Maintaining correct spacing for each magnet and the associated section of moveable diaphragm over large surface areas is difficult to efficiently manufacture and subsequently maintain over years of expected performance.

These unique manufacturing requirements result in higher costs for such large structures, particularly in view of the stabilizing structure that must be added to rigidly secure speaker components at desired positions, despite movement and speaker impact that is foreseeable during normal use. These conditions have resulted in high cost, which has severely limited the marketability of the single end speaker.

In addition to adverse cost impact, the large size requirement of single end systems has significantly limited practical use. Most speaker applications require smaller sizes because of the limited space available. For example, speakers in small rooms and vehicles require minimal size. Market trends are shifting to smaller sizes in the dynamic speaker field, such as speaker cubes and related systems having a volume of less than several cubic inches. This is in contrast to single end speakers which have a surface area of several feet.

In addition to the large volume of space required, single end planar magnetic speakers are generally heavy and cumbersome. Consider, for example, the illustrated single end system shown in FIG. 1 of U.S. Pat. No. 3,919,499 of Winey, showing a small room significantly filled with speaker components along one wall. Such large speaker design has been deemed necessary in view of the limitations set forth above. Here again, this requirement for large size is in direct opposition market trends of compactness and low profile. Additional patents relating to the single end speaker technology are identified as follows:

| | | |
|---|---|---|
| 3,919,499 | Winey | Nov. 11, 1975 |
| 4,210,786 | Winey | Jul. 1, 1980 |
| 3,209,084 | Gamzon, et al | Sep. 28, 1965 |
| 3,013,905 | Gamzon, et al | Dec. 19, 1961 |
| 3,674,946 | Winey | Jul. 4, 1972 |

In summary, neither the double end, nor single end version of the planar magnetic speaker has reached a viable stage of development which makes it competitive with dynamic speakers having much higher efficiency. This lack of successful development over a period of more than fifty years provides strong evidence of obstacles within this technology requiring creative invention. Even the appearance over the last decade of high energy magnets such as those of neodymium has failed to lead to improvements, particularly within the single end speaker structure. At best, the application of high energy magnets has been applied to the push-pull tweeter system as shown in U.S. Pat. No. 5,901,235 by Thigpen et al. As is illustrated in FIG. 4 of Thigpen, such a speaker device includes mounting structure 40, a support plate 41 capable of opposing the strong repulsion forces of the push-pull system, and attached neodymium magnets 43 juxtaposed to the diaphragm 44 and associated conductive coil 45. The close proximity of the illustrated adjacent neodymium magnets poses additional manufacturing and design criteria, however, in view of a much higher repulsion forces now imposed, on the frame and support structure. These forces are magnitudes higher than prior art ceramic magnet structures, further increasing the cost and complexity of a viable speaker device.

What is needed is a simple planar magnetic speaker which is favorable in cost of construction, small in size and equal in performance to current dynamic and electrostatic speaker systems.

SUMMARY OF THE INVENTION

The invention accordingly provides a single end planar magnetic loudspeaker system comprising at least one thin film, flexible diaphragm having a front side and a rear side for converting an input electrical signal into a corresponding acoustic output, said at least one diaphragm including a predetermined, conductive region and a predetermined non-conductive region. The system further includes a magnetic structure utilizing nonferite high energy magnets of a predetermined thickness wherein the magnets are each at least as wide as they are deep. The magnets having a magnetic strength wherein when compared to magnets of a ferrite type of same width as a nonferite high energy magnets but which have increased depth to yield at least nearly the same magnetic strength as the high energy magnets in the magnetic structure, doubling the depth of the high energy magnets in the magnetic structure yields an increase in speaker sensitivity of at least 3 dB while the doubling the depth of the ferrite type magnet will yield gain of less than 3 dB. The system further includes a mounting structure coupled to the diaphragm to capture the diaphragm, hold it in a predetermined state of tension, and space it at a predetermined distance from the magnetic structure.

In other aspect the system can comprise a planar magnetic loudspeaker system including: (a) at least one thin film, flexible diaphragm having a front side an a rear side for converting an input electrical signal into a corresponding acoustic output, said at least one diaphragm including a predetermined conductive region and a predetermined non-conductive region and a total vibratable surface area of less than 150 sq inches; (b) at least one high energy magnetic structure of predetermined thickness positioned adjacent to said at least one thin film, flexible diaphragm, wherein the magnetic structure is at least 0.060 thousands of an inch in thickness and operable to provide a speaker sensitivity of at least 85 dB at a power level of one watt; an (c) a mounting structure configured part of a single end planar magnetic speaker and coupled to the diaphragm to capture the diaphragm, hold it in a predetermined state of tension and space it at a predetermined distance from the magnetic structure.

In further more detailed aspect the magnetic structure can be made sufficiently thin to yield at least a 3 dB increase in SPL based solely on comparison of SPL output of a planar magnetic loudspeaker system of comparable construction having an operable magnetic structure of common composition with the high energy magnetic structure and which is approximately one-half the predetermined thickness of the high energy magnetic structure. Furthermore the magnetic structure can be made sufficiently thin to yield at least a 5 dB increase in SPL based solely on comparison with the SPL output of the operable magnetic structure which is approximately one-half the predetermined thickness of the high energy magnetic structure. In further detail, the magnetic structure can be made sufficiently thin to yield at least a 6 dB increase in SPL based solely on comparison with the SPL output of the operable magnetic structure which is approximately one-half the predetermined thickness of the high energy magnetic structure.

In another more detailed aspect, the width of a magnetic structure can be made greater than the thickness of a magnetic structure. The mounting structure can include a loading barrier adjacent to and at a predetermined distance in front of a portion of the front side of said diaphragm. This barrier can be adjacent a portion of both the front and back sides of said diaphragm. Furthermore, the system can include at least one proximity loading baffle positioned at a periphery of the diaphragm and substantially enclosing a partially confined volume of air between the diaphragm and loading barrier to maintain substantially balanced loading of the diaphragm during audio reproduction.

In a further more detailed aspect, the magnetic structure can comprise neodymium.

In another more detailed aspect, the system can comprise: (a) at least one thin film vibratable diaphragm having a front side and a rear side for converting an input electrical signal into a corresponding acoustic output, said at least one diaphragm including a predetermined conductive region and a predetermined non-conductive region, said predetermined conductive region having a total operable surface area of less than 150 square inches; (b) at least one high energy magnetic structure of predetermined thickness positioned adjacent to said at least one thin film vibratable diaphragm, said diaphragm and magnetic structure being cooperatively capable of generating acoustic output covering at least a midrange and upper range of audio frequencies; and (c) a mounting structure coupled to the diaphragm to capture the diaphragm, hold it in a predetermined state of tension and space it at a predetermined distance from the magnetic structure.

In a further more detailed aspect, the system can comprise a total operable surface area which is less than 100 square inches. In further detail, the total operable surface area can comprise less than 50 square inches.

In another more detailed aspect, a planar magnetic loudspeaker system in accordance with the invention can include at least one thin film vibratable diaphragm having a front side and a rear side for converting an input electrical signal into a corresponding acoustic output, said at least one diaphragm including a predetermined conductive region and a predetermined non-conductive region, said diaphragm having a composition of polyethylenenaphthalate (PEN); and also include at least one high energy magnetic structure of predetermined thickness positioned adjacent to said at least one thin film vibratable diaphragm; said diaphragm and magnetic structure being cooperatively capable of generating acoustic output covering at least a midrange and upper range of audio frequencies; and can further include a mounting structure coupled to the diaphragm to capture the diaphragm, hold it in a predetermined state of tension and space it at a predetermined distance from the magnetic structure.

In a further more detailed aspect, said loudspeaker as just defined can have a total operable surface area is less than 150 square inches, even less than 100 or less than 50 square inches.

In another detailed aspect, the single end planar magnetic loudspeaker system can comprise: (a) a single thin film vibratable diaphragm having a front side and a rear side for converting an input electrical signal into a corresponding acoustic output, said diaphragm including a predetermined conductive region and a predetermined non-conductive region, said diaphragm having a composition selected from the group consisting of polyethylenenathalate (PEN), polyurethane, crosslinked polyurethane, Kapton, and Mylar; (b) at least one high energy magnetic structure having a power rating of at least 25 MGO and of predetermined thickness positioned adjacent to said thin film vibratable diaphragm, said diaphragm and magnetic structure being cooperatively capable of generating acoustic output covering at least a midrange and upper range of audio frequencies; and (c) a mounting structure coupled to the diaphragm to capture the diaphragm, hold it in a predetermined state of tension and space it at a predetermined distance from the magnetic structure. In a more detailed aspect, such a system can include a total operable surface area less than 150 square inches, or even 100 square inches.

In further detail, the system can comprise: (a) at least one thin film vibratable diaphragm having a front side and a rear side for converting an input electrical signal into a corresponding acoustic output, said at least one diaphragm including a predetermined conductive region and a predetermined non-conductive region; (b) at least one high energy magnetic structure of predetermined thickness positioned adjacent to said at least one thin film vibratable diaphragm, wherein the magnetic structure utilizes magnetic material which provides an energy product of at least 25 MGO; and (c) a mounting structure coupled to the diaphragm to capture the diaphragm, hold it in a predetermined state of tension and space it at a predetermined distance from the magnetic structure. In further detail, such a system can be configured so the energy product is a least 30 MGO.

In a further detailed aspect, the system just before mentioned can have a conductive region which further includes a conductive foil bonded to the diaphragm to form a conductive circuit having a foil surface on one of the front or rear sides of the diaphragm, said diaphragm being held in the predetermined state of tension through shrinkage of the vibratable film to the state of tension, while a portion of the foil which is bonded to the foil substantially retains an original dimension in an absence of shrinkage. In further detail, the diaphragm can have a thickness of less than 50 microns and the conductive circuit can comprise a thin foil of aluminum having a thickness of less than 50 microns.

In another more detailed aspect, a method for preparing a vibratable diaphragm for use in a planar magnetic speaker, comprising the steps of a) selecting a roll of flexible film suitable for use as a speaker diaphragm; b) applying a thin layer of adhesive to one side of the film; c) bonding a layer of conductive foil to the adhesive to form a rolled film laminate sized for use on a press; d) applying a resist coat pattern to the foil side of the film laminate in a desired circuit configuration for use in the planar magnetic speaker; and e) removing the non-resist portions of the conductive foil from the film to provide the conductive circuit.

In a further more detailed aspect, the method just set forth can comprise the additional steps of: f) applying a protective coating to the conductive circuit side of the foil of step e); and g) rolling the coated foil for future processing. The method can further include the more specific step of applying a thin layer of cross linking polymer as the adhesive. In further detail, step c) can further include the more specific step of bonding a layer of aluminum as the conductive foil having a thickness of less than 50 microns. Moreover, step d) can include the more specific step of applying the resist coat pattern to the foil side of the film laminate in a circuit configuration for use in a single end planar magnetic speaker. The method can include the more specific step of applying cross linking polyurethane as the adhesive.

In another more detailed aspect, a method for shrinking a vibratable film for use with a bonded electrically conductive circuit disposed thereon, can include the steps of: a) selecting a film of polyethylenenaphthalate having thickness of less than 100 microns and having the conductive circuit disposed on a side of the film; b) applying ultraviolet radiation at the side of the film having the conductive circuit; and, c) maintaining the ultra violet radiation for sufficient time to shrink dimensions of a portion of the film which is not bonded to the conductive circuit, without causing significant shrinkage of the film which is bonded to the conductive circuit, thereby preserving an integral and unwrinkled attachment configuration between the film and circuit.

In a further more detailed aspect, a method for permanently attaching a vibratable diaphragm with a desired tension as part of a planar magnetic speaker can include the steps of: a) selecting a film of polyethylenenaphthalate having a thickness of less than 100 microns and having the conductive circuit disposed on a side of the film; b) positioning the film for attachment on a speaker support frame in tension; c) permanently attaching the film at a periphery to the frame for use as a speaker diaphragm for the planar magnetic speaker; d) applying ultraviolet radiation at the side of the film having the conductive circuit; and e) maintaining the ultraviolet radiation for sufficient time to shrink dimensions of a portion of the film which is not bonded to the conductive circuit to the desired tension, without causing significant shrinkage of the film which is bonded to the conductive circuit, thereby preserving an integral and unwrinkled attachment configuration between the film and circuit.

In another more detailed aspect a planar magnetic loudspeaker in accordance with the invention can comprise: a) a diaphragm of thin, tensionable film including a conductive region and a non-conductive region; b) a magnetic structure positioned adjacent and a predetermined distance from said diaphragm for interaction with the conductive region of the diaphragm; c) a collapsible speaker frame with a plurality of spring biased mounting arms for attachment of the diaphragm at the predetermined distance, said mounting arms having a first, static position at rest, and a second, tensioned position wherein a distance between the mounting arms in the tensioned position is less than a separation distance in the static position and corresponds to a predetermined tension to be applied to the diaphragm during use; and, d) means for permanently attaching the diaphragm to the mounting arms of the speaker frame.

Further features and advantages will be appreciated with reference to the following detailed description and appended drawings, which illustrate by way of example, and not by way of limitation, such features and advantages.

DETAILED DESCRIPTION OF PREFERRED EMBODIMENTS

Figure 1:
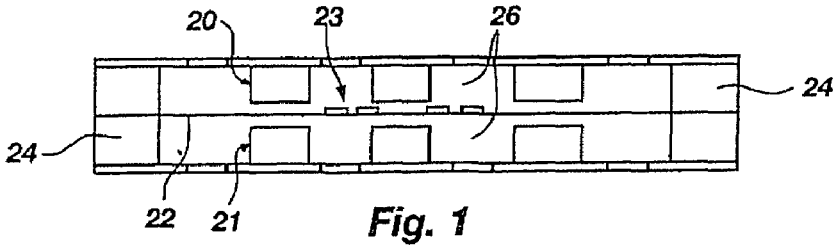
Fig. 1 (PRIOR ART)
FIG. 1 is a cross-sectional view of a conventional double ended planar magnetic speaker configuration.
Figure 2:
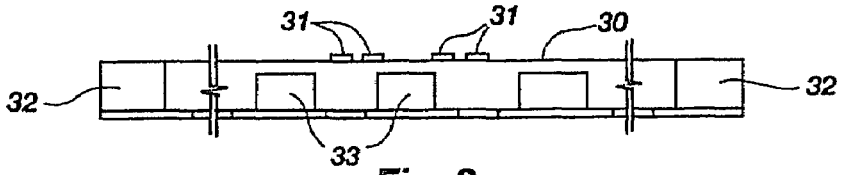
Fig. 2 (PRIOR ART)
FIG. 2 is a cross-sectional view of a conventional single ended planar magnetic speaker configuration.
Figure 3:
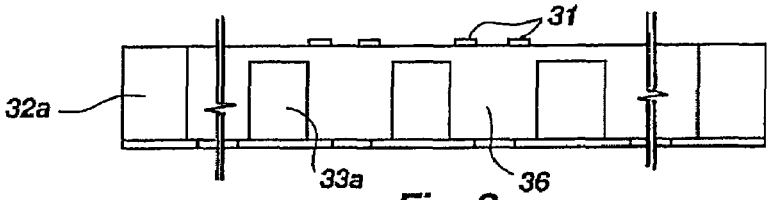
Fig. 3 (PRIOR ART)
FIG. 3 is a cross-sectional view of another conventional single ended planar magnetic speaker configuration.
Figure 4:
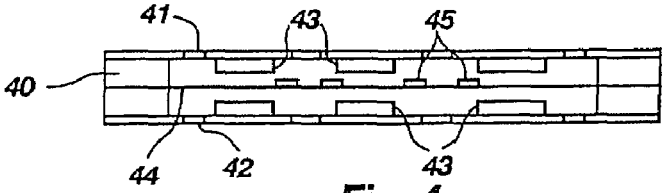
Fig. 4 (PRIOR ART)
FIG. 4 is a cross-sectional view of a conventional double ended speaker configuration.
Figure 5:
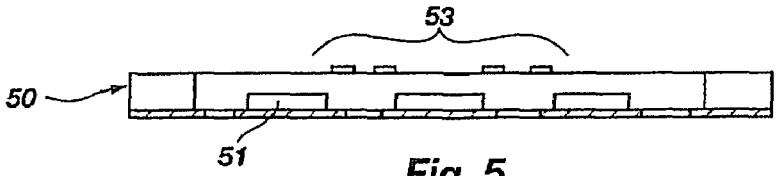
FIG. 5 is a cross-sectional view of a single ended planar magnetic speaker configuration in accordance with principles of the invention.
Figure 6:
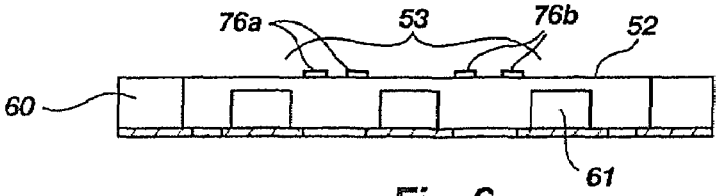
FIG. 6 is a cross-sectional view of a single ended planar magnetic speaker configuration in another embodiment of the invention.

FIGS. 5 and 6 illustrate one of the basic discoveries of the present invention which has enable the accomplishment of an inexpensive planar magnetic speaker device which is small in size and surprisingly high in quality audio performance. It includes a surprising observation that, unlike prior art ceramic magnets, a high energy magnet such as neodymium as applied in a double ended or push pull tweeter system, can be doubled in thickness and will generate an additional 3 to 6 dB in acoustic output. This is in direct contrast with prior art experience with ceramic or ferrite magnets of common flux density in planar magnetic systems. In other words, it has been discovered that high energy magnets have the unexpected property of generating greater SPL with increased thickness dimensions than prior art ceramic or ferrite based magnets. Specifically, when the magnetic structure is designed as set forth hereafter, it is sufficiently thin to yield at least a 3 dB increase in SPL based solely on comparison of SPL output of a planar magnetic loudspeaker system of comparable construction having an operable magnetic structure and which is approximately one-half the predetermined thickness of the high energy magnetic structure.

This can be viewed from another perspective, in comparison with the prior art ferrite magnetic structure. A magnetic structure utilizing nonferite high energy magnets of a predetermined thickness in accordance with the present invention can be characterized by the unexpected increase in SPL as compared to prior art ceramic and ferrite magnets of similar dimension. Specifically, the single end planar magnetic speaker includes at least one thin film, flexible diaphragm having a front side and a rear side for converting an input electrical signal into a corresponding acoustic output. As with previous examples, the diaphragm includes a predetermined conductive region and a predetermined non-conductive region. The magnetic structure utilizes nonferite high energy magnets of a predetermined thickness as described herein, wherein the magnets are each at least as wide as they are deep. The unexpected SPL improvement is defined by a condition wherein the magnets are each at least as wide as they are deep; and the magnets have a magnetic strength wherein:

(i) when compared to magnets of a ferrite type of same width as the nonferite energy magnets;

(ii) but which have increased depth to yield at least nearly the same magnetic strength as the high energy magnets in the magnetic structure, doubling the depth of the high energy magnets in the magnetic structure yields an increase in speaker sensitivity of at least 3 dB while the doubling the depth of the ferrite type magnet will yield a gain of less than 3 dB.

For example, FIG. 5 illustrates a single end device 50 having three bars of neodymium 51 supported adjacent a diaphragm 52 with conductive region 53. The thickness of these bars 31 is approximately 0.025 inches. By increasing the thickness of the device 60 and magnets 61 to approximately 0.055 inches as shown in FIG. 6, the single end system produces the surprising increase of 6 dB. In essence, this enables the equivalent benefit of a flux density of a double ended or push pull system, without the attendant problems of opposing magnetic fields from opposite sides of the diaphragm.

Because of this unexpected discovery, it is therefore possible to simplify the frame and support structure, having avoided the problematic use of additional magnets comprising the double ended system. This enables cost reduction based on simplified structural components and materials. For examples, a single 0.055 inch bar magnet is less expensive than two 0.025 inch bars, yielding significant savings. The audio output of the single end device is surprisingly comparable to conventional dynamic speakers. Specifically, doubling the depth of a ceramic magnet of the name force yields only a 2 dB enhancement, only one third that offered by the present invention.

Neodymium is commonly referred to as a "high energy" magnetic material. Ceramic magnets, for example, are rated at about 5 megagauss oersteds (MGO), whereas neodymium material is generally greater than 25 MGO. Some NeFb technology has realized 40 to 50 MOO. Other high energy materials having at least 25 MGO are available and are known to those skilled in the art. Reference to "high energy" magnets hereafter shall mean magnets providing at least 250 to 40 to 50 or more MGO.

In retrospect, it now appears that prior art single ended structures have been too large and too inefficient for commercial acceptance. Push pull systems have been available for smaller devices, but have not realized commercial success in view of (i) attendant interference in high frequencies, (ii) a need for stronger structures to resist bowing and deformation of the diaphragm support structure due to opposing magnetic forces, and (iii) the use of larger gaps between magnets to avoid close, intense fields. Smaller, single ended structures using high energy materials such as neodymium provide the required efficiency and power level, with an open audio emission window for both midrange and high frequencies, allowing effective cross over with a subwoofer to realize a full range audio experience. Such a system is no less expensive than a comparable dynamic speaker, and surprisingly high in quality. Enhanced quality is realized by providing undriven edges of the diaphragm with film loading devices for damping to provide effective dispersion of high frequencies.

Figure 7:
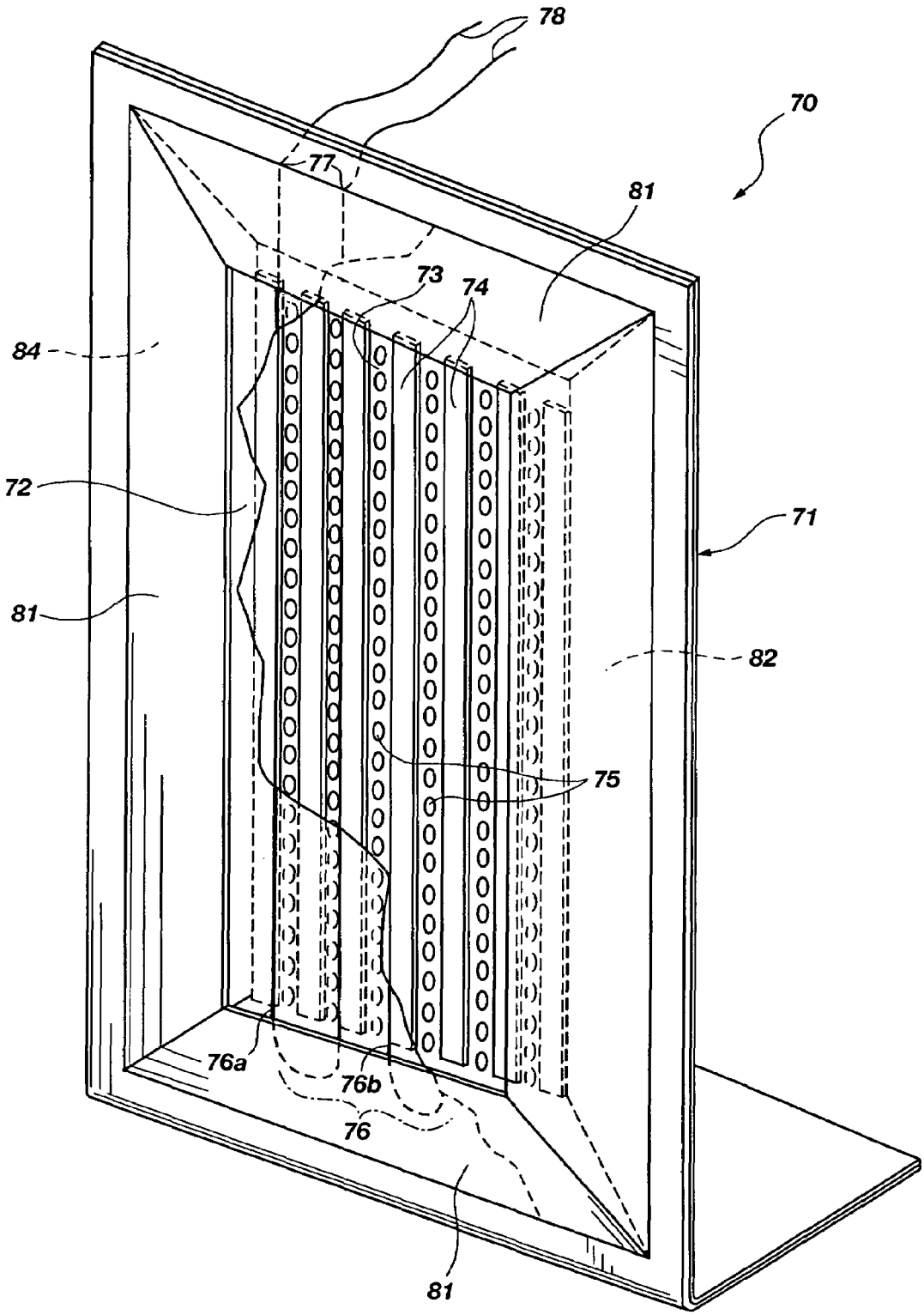
FIG. 7 is a perspective view, partially in cut-away, of a planar magnetic speaker device in accordance with principles of the invention.

FIG. 7 shows a perspective view of a single ended planar speaker 70 of the present invention. A mounting frame 71 provides rigid support for assembly of the remaining components. It must offer sufficient rigidity to keep the tensioned diaphragm 72 dimensionally stable. The frame may be made of various materials providing desired rigidity such as stamped metal, molded plastics, wood, and comparable materials. Although the shape is illustrated as rectangular, other shapes are available such as circular, polygonal, elliptical, etc.

The frame 71 is coupled to a magnet mounting plate 73 which supports an array of high energy magnets 74. The plate 73 may be ferrous to provide magnetic shielding and optimum magnetic performance. If a nonferrous plate is used, a reduction in effective field strength may occur, i.e. a possible 15% loss of magnetic force in the working air gap. Perforations 75 in the plate enable emission of rear wave energy. Such perforations may be adjusted in size and density to provide resistance loading and damping of the diaphragm to optimize audio output.

High energy magnets 74 are mounted to plate 73 in parallel array. Uniform spacing between the bars 74 is preferred, with separation distances being empirically set to optimize the field strength applied to the diaphragm conductive area 76. Typically, the width of the bar will be approximately twice the thickness, but other dimensions may be applied as well. Accordingly, for a thickness of 0.095 inches, the bar width is approximately 0.188 inches. Separation distance between each bar is 0.188 inches or approximately the same as the width of the bar. These dimensions are based on a system having a total width of 6 inches and height of 8 inches. The bars are adhesively attached to the mounting plate with an acrylic anaerobic glue or other high strength and heat resistant material. Polarity orientation for respective adjacent bars is in opposing position (every row is opposite an adjacent row).

The diaphragm 72 is tensioned by one of several available tensioning methods against the frame and bonded in the tensioned configuration with cyanoacrylate or another fast curing crystalline bonding agent 77. The bond should be permanent, meaning that the diaphragm cannot move after assembly. Any loss in tension would result in changes in diaphragm performance and speaker output. The diaphragm may be of Mylar™, Kapton™, crosslinked polyethylene, polyurethane, polyethylenenaphthalate (PEN) or other comparable film materials. PEN has been discovered to possess favorable performance characteristics, as well as being well suited for a preferred method of tensioning, which is disclosed hereafter.

PEN can be used with crosslinked adhesives to provide higher acoustic performance, higher thermal resistance and compatibility with low cost fabrication techniques. For example, high speed etching processes can be applied to create precise aluminum conductor patterns on the diaphragm. Crosslinked adhesives are approximately $1/10^{th}$ the mass of prior art planar magnetic diaphragm adhesives used for bonding aluminum to prior art films. The crosslinking polymer adhesives generally provide instantaneous curing, which is critical to the print/etch process to be explained hereafter. In this process, the foil material is printed onto the film surface (rather than laminated) so the deposit thickness is approximately 0.000095 inches, enabling the reduction of mass to minimal levels. Film thickness is in accordance with conventional practice for planar magnetic systems.

A particularly useful procedure for tensioning the diaphragm has been developed in connection with PEN and similar films. Prior art techniques typically heat the film such as Mylar, allowing it to tighten as it shrinks. Many problems have been experienced with respect to this technique. A common difficulty is the wrinkling or delamination of the film from the conductive elements. The inventor has discovered that application of ultraviolet radiation as opposed to conventional energy sources avoids these problems. Specifically, UV radiation is directed on the film to selectively heat and tension the film on the frame. Apparently, the UV energy passes through any damping layer materials and is reflected by the metal conductive materials. The elements of the driver do not absorb the UV energy and therefore do not disturb or stress the areas which do not tolerate high heat. By applying this technique, the proper tensioning of the diaphragm can be accomplished without prior art experience of delamination. Bi-axial tensioning devices are also available which control tension in both axes simultaneously while film is in motion, enabling high speed production. This process is explained hereafter.

Because the simplified production methods and materials are of nominal expense, the single ended planar speaker can offer the advantages of low cost and high quality, while also providing small size to accommodate many uses. Where larger speaker devices are desired, multiple small planar speakers can be inter-connected to make both planar and non-planar panels.

Figure 11:
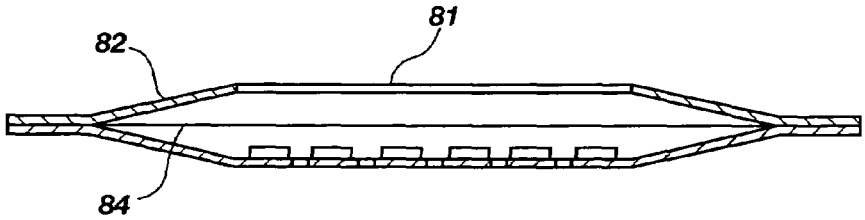
FIG. 11 is a cross-sectional view of a planar magnetic speaker device in another embodiment.

As indicated above, the conductive region 76 is provided on the diaphragm by attaching conductive wires, strips, or elements 76*a*. Patch points 77 provide contacts for coupling electrical leads 78 to the speaker and will typically be soldered in place. Alternatively, an eyelet can be pressed into the aluminum conductive material. These patch points operate as input terminals for the audio signal, and are electrically coupled at an opposing end to an appropriate amplifier or other signal source. Multiple contact points or series connections can be implemented for additional conductive elements 77*b*, etc. The preferred alignment of the conductive elements 76*a* and 76*b* is over the air gap position between adjacent magnetic bars. FIG. 6 illustrates one such orientation. Other positions are shown in the cross-sectional FIGS. 9 and 11. Other configurations will be apparent to those skilled in the art, and are intended to be comprehended by this disclosure.

The conductive elements may be applied to the diaphragm by direct bonding of conductive wires, vapor deposition, conventional etching techniques, and other methods which will permanently adhere a conduction element on the diaphragm. The preceding disclosure indicated the preferred use of a thin layer of crosslinked adhesives to provide higher acoustic performance, higher thermal resistance and compatibility with low cost fabrication techniques. Cyanoacrylate is one example of such an adhesive. These adhesives are valuable because they are very stable at 300 degrees F., enabling demetalization as is explained hereafter. Furthermore, thermal performance of these materials generally exceeds that of the film. They also remain unaffected by the acids that are used to remove the metal layer. Accordingly, the aluminum can then be etched from the PEN film to leave a desired conductive pattern. Variations in pattern from those disclosed are within knowledge of those skilled in the art. These techniques are discussed in detail hereafter as part of a preferred fabrication methodology.

Figure 8:
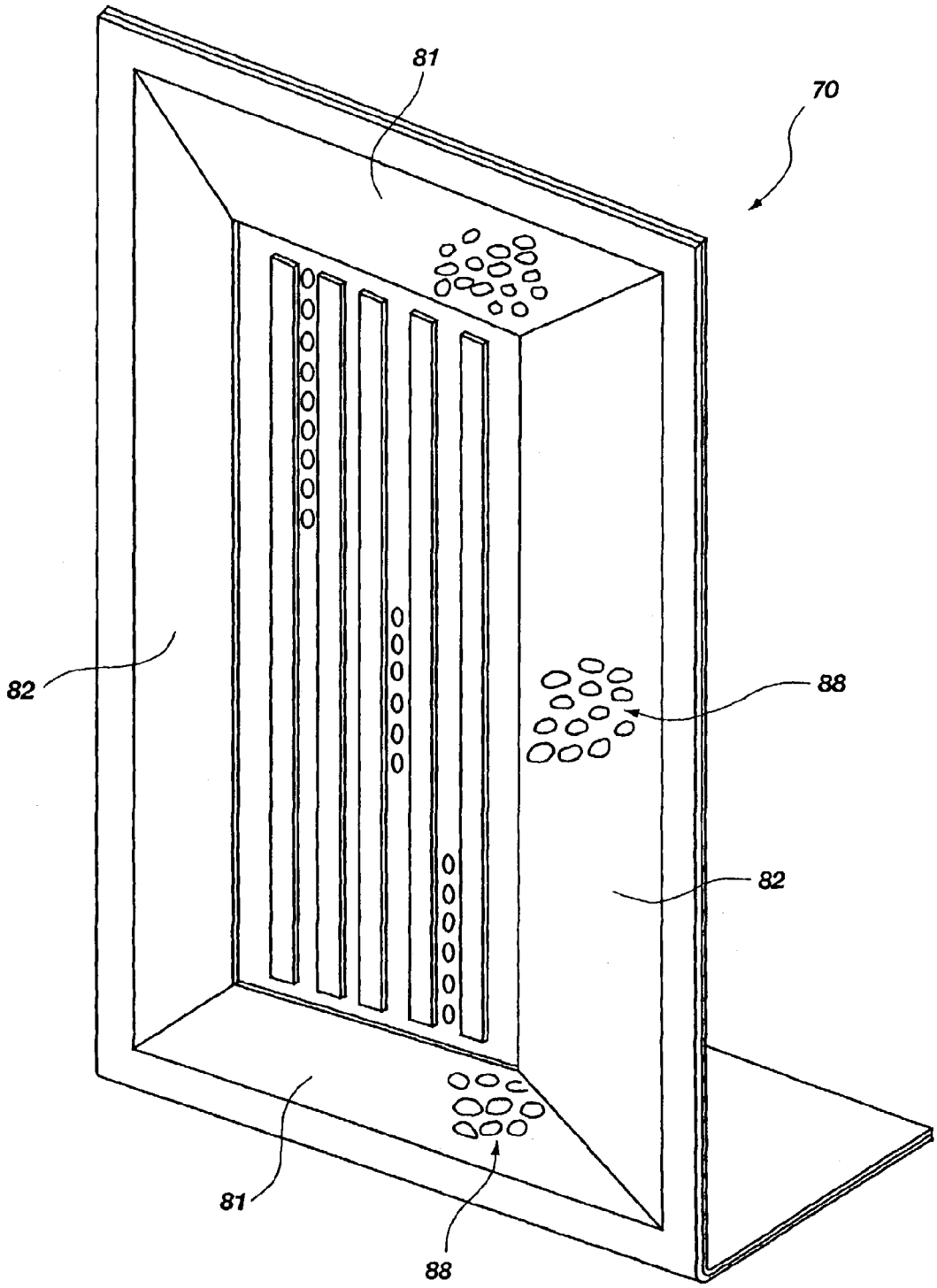
FIG. 8 is a perspective view of a planar magnetic speaker device in another embodiment.

FIG. 8 discloses an added novel feature of this invention involving the use of loading barriers or proximity loading baffles (PLB) such as illustrated at items 81 and 82. The PLB is formed along with the mounting frame and projects slightly above the undriven portion 84 of the diaphragm around the edges. As these edge portions of the diaphragm vibrate or move along with the driven region of the diaphragm, the small volume of air captured between the PLB and diaphragm edge operates as a damping medium for low frequencies, while allowing higher frequencies to propagate substantially unimpeded. The small dimensions of this enclosed space allow emission of the higher frequencies, enabling broad dispersion to the listeners, whereas, high-frequency beaming may otherwise occur.

A simple form of frame support for the present invention is a shallow dish-shaped rectangle into which the magnets are bonded centrally, and the diaphragm is bonded peripherally. The PLB or shield portion is formed as a picture frame and is attached to the support frame at the periphery, capturing the undriven, peripheral portion of the diaphragm. FIG. 8 illustrates the addition of perforations 88 on the PLB structure 81 and 82. Extensive use of such openings 88 converts the side flange structures from PLB to acoustic transparency.

Figure 9:
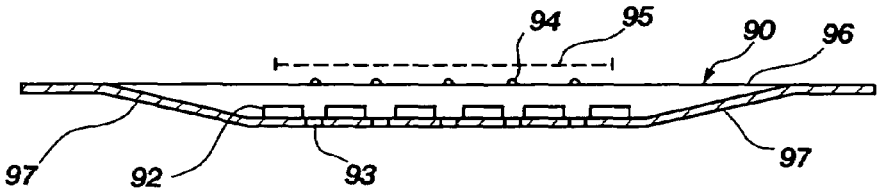
FIG. 9 is a cross-sectional view of a single ended planar magnetic speaker device in accordance with principles of the invention.

FIG. 9 shows how a simplified PLB can be implemented on the rear side of the diaphragm 90. In this case, the mounting plate 97 carries the magnets 92 and includes perforations 93 to allow back emission of sound. Conductive elements 94 collectively define the active driven region of the diaphragm 95. At the edges 96 are undriven areas of diaphragm which could result in adverse resonance effects and noise. These effects are countered by the damping effect of the PLB portions 97 in accordance with the discussion above. Additional perforations can be added to fine tune the desired loading and damping effects as desired.

Figure 10:
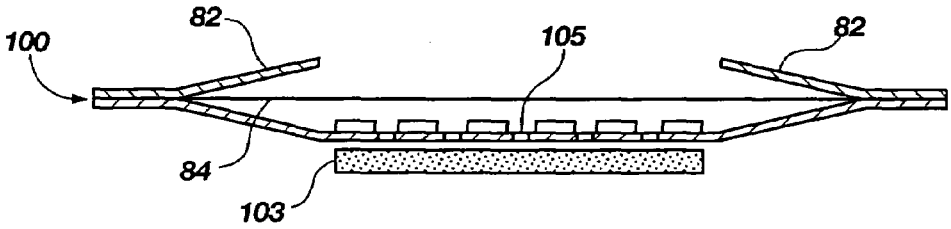
FIG. 10 is a cross-sectional view of a planar magnetic speaker device in another embodiment.
Figure 12:
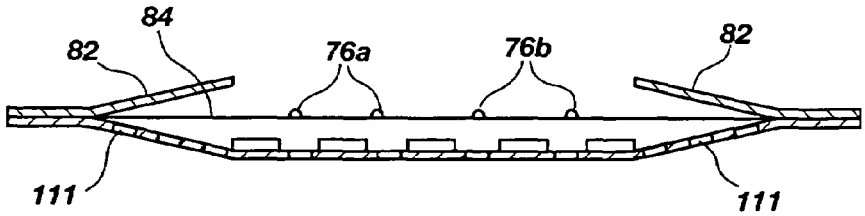
FIG. 12 is a cross-sectional view of a planar magnetic speaker device in another embodiment.
Figure 13:
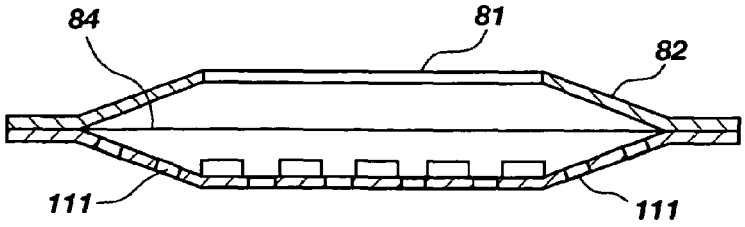
FIG. 13 is a cross-sectional view of a planar magnetic speaker device in another embodiment.

FIG. 10 illustrates a planar magnetic speaker 100 having the back-damping structure of FIG. 9, with a forward PLB structure 82. As was previously discussed, PLB elements 82 (on the sides of FIG. 7) and 81 (relating to the top and bottom portions of the diaphragm in FIG. 7) provide the desired damping and energy control functions. This figure illustrates the addition of a felt member 103 for absorbing part of the back wave energy emitted through the apertures 105. The same effects can be developed with smaller openings in place of the larger perforations. FIGS. 12 and 13 depict the use of perforations 111 on the rear PLB structure.

The various embodiments represented above provide guidelines for implementing the basic inventive principles and structure set forth in the disclosure and claims. General dimensions of the speaker can be increased or reduced, as applications dictate. The preferred embodiment can be uniformly adjusted in size from as large as 150 square inches of driven area, down to the size of a credit card or less (several square inches). Preferred dimensions are widths in the range of 5.0 to 10.0 inches and heights of 5.0 to 30.0 inches. PLB dimensions are approximately 1 to 2 inches in width and 4 to 10 inches in height, scaled to the preferred embodiment shown herein.

Figure 14:
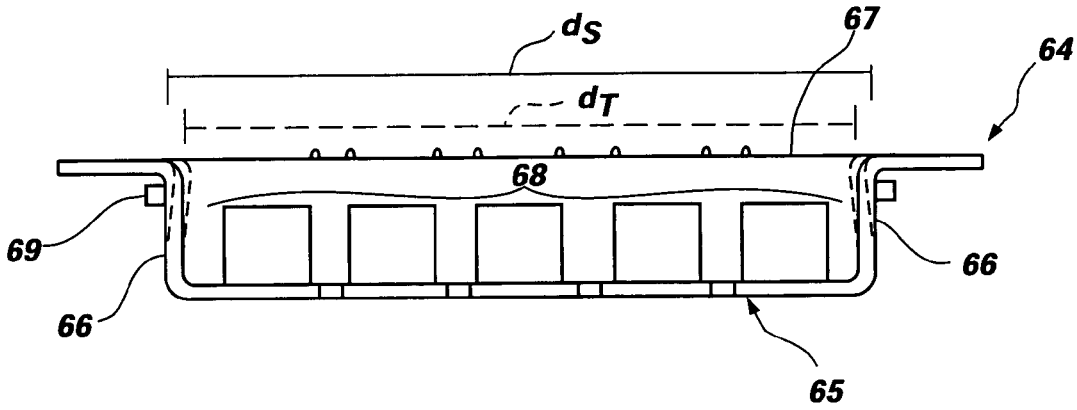
FIG. 14 is a flowchart diagram illustrating a method used in making a planar magnetic speaker device in accordance with principles of the invention.

Alternatively, a simple mounting construction is illustrated in FIG. 14, wherein a planar magnetic loudspeaker 64 includes a collapsible speaker frame 65 with a plurality of spring biased mounting arms 66 for attachment of the diaphragm 67 at the preferred distance from the magnetic structure 68. The mounting arms 66 have a first, static position at rest as shown, and a second, tensioned position illustrated in phantom line wherein a distance d(t) between the mounting arms in the tensioned position is less than a separation distance d(s) in the static position. This difference applies a force F to the diaphragm which approximately corresponds to a predetermined tension to be applied to the diaphragm during use. The procedure for mounting the diaphragm involves coupling a tensioning ring 69 around the collapsible frame and reducing the distance of the arms 66 to slightly smaller than the desired distance d(t). The film is then bonded to the upper surfaces of the arms for permanent attachment. When the ring is released, the spring biased structure is designed to apply force F to establish the correct tension.

Figure 15:
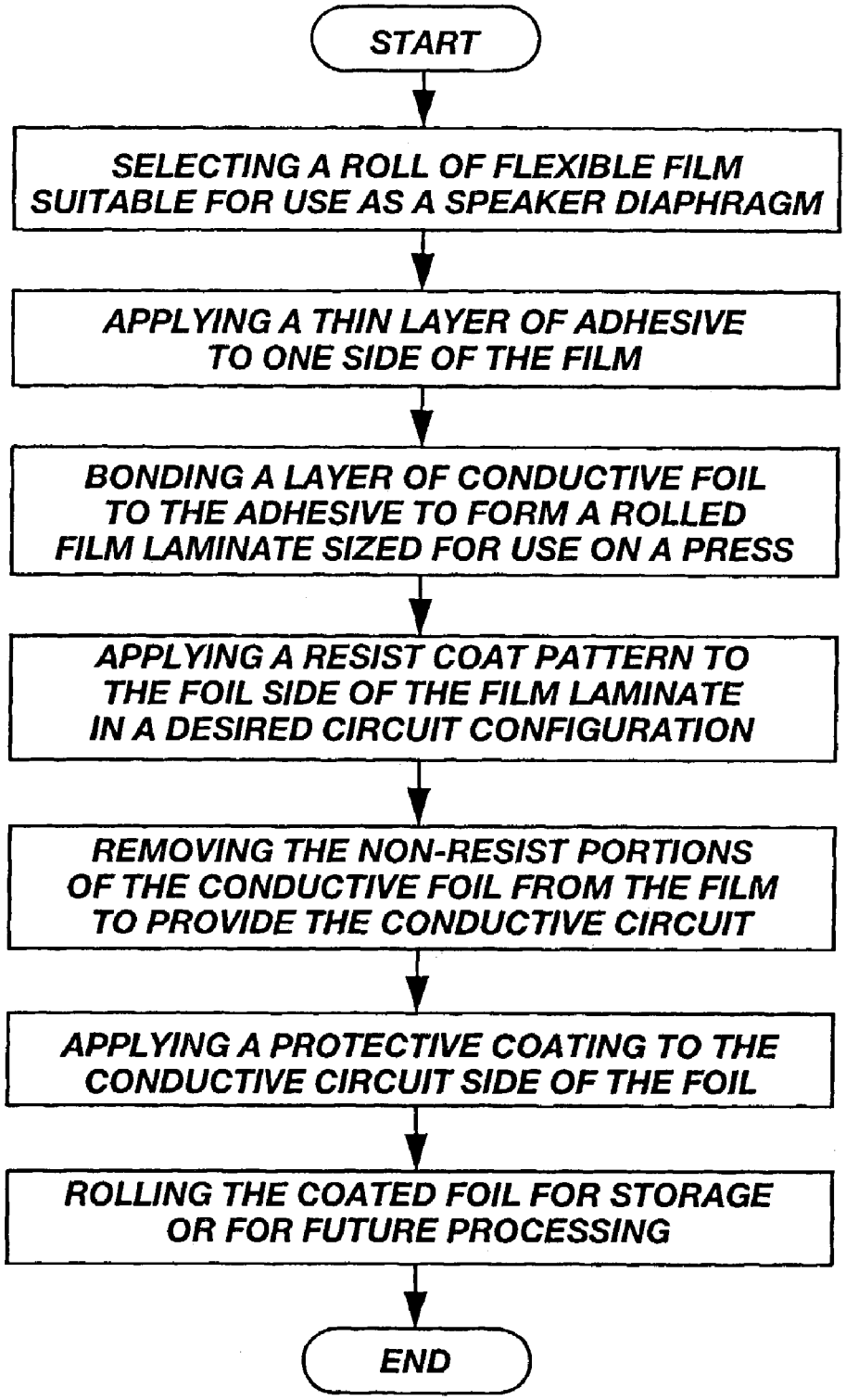
FIG. 15 is a cross-sectional view of a single end planar magnetic speaker in another embodiment.
Figure 16:
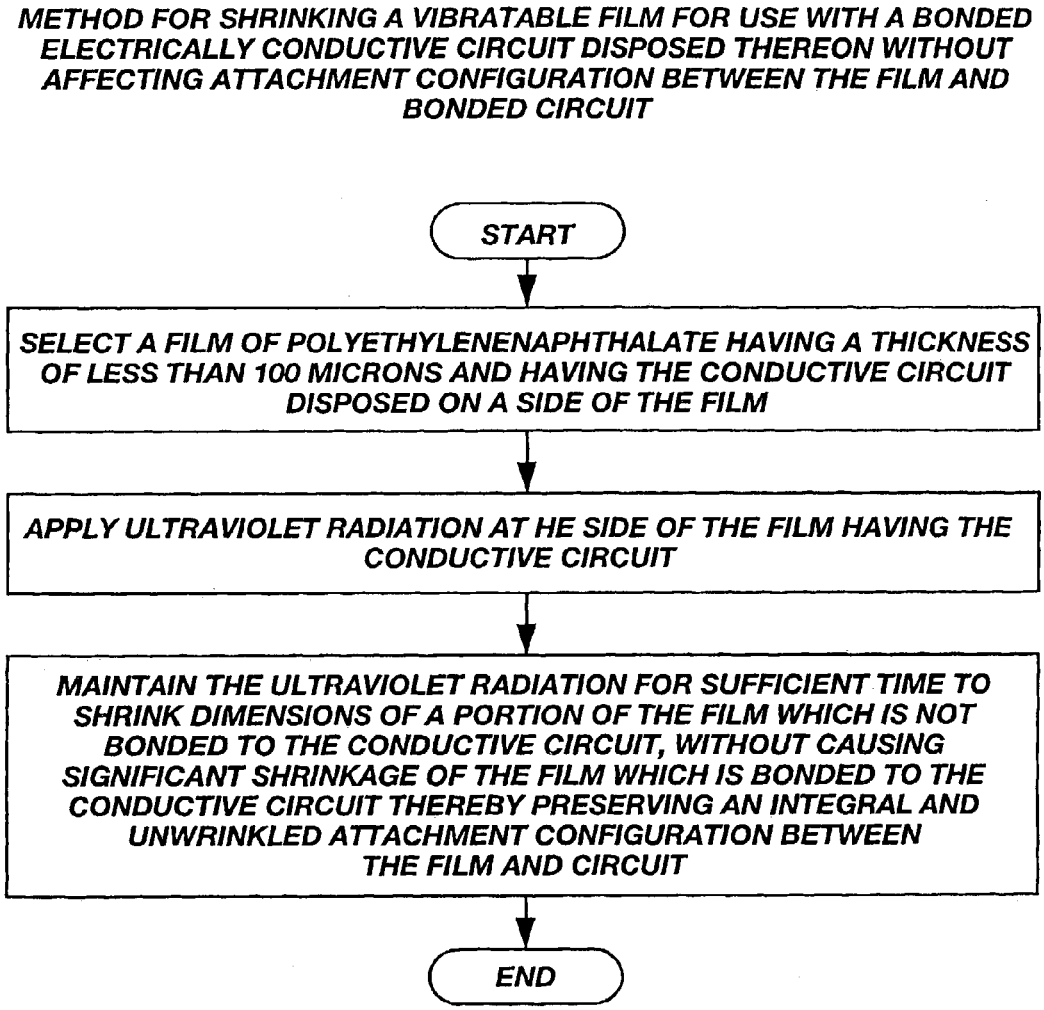
FIG. 16 is a flowchart diagram illustrating a method used in making a planar magnetic speaker device in accordance with principles of the invention; and, FIG. 17 is a flowchart diagram illustrating a method used in making a planar magnetic speaker device in accordance with principles of the invention.
Figure 17:
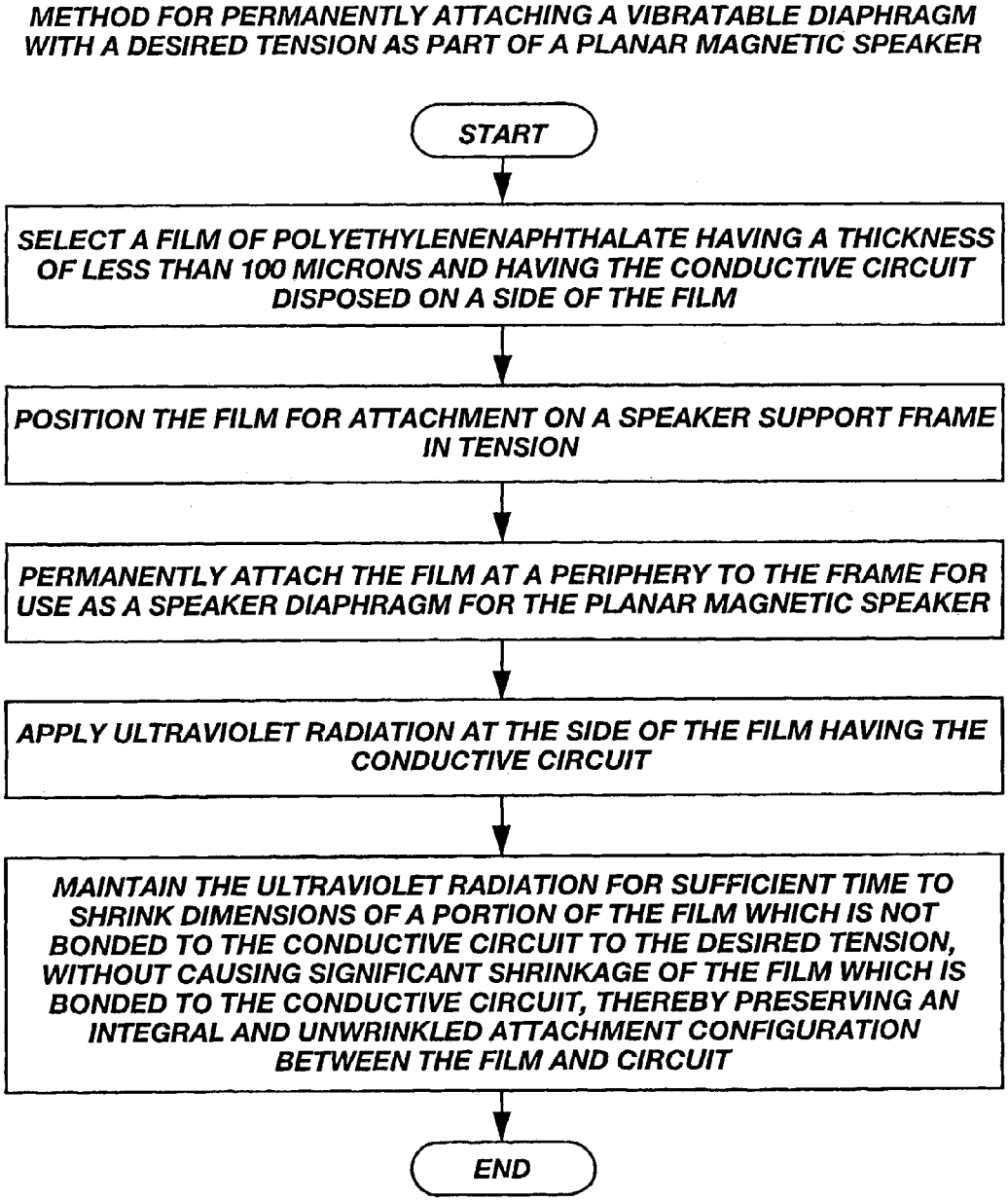

A preferred method of fabrication of the film with attached conductive elements will now be discussed. FIG. 15 provides a block diaphragm of the basic manufacturing procedures utilizing a high speed, low cost, printing press system. By adopting this method of fabrication, substantial cost savings accrue, enabling the planar magnetic loudspeaker to be very cost competitive with other forms of speaker devices. The specific procedure utilizes a large scale, high speed laminating, resist printing and etching system which applies the desired conductive circuit on the film in a rapid and accurate manner. It is accomplished as follows:

A. Rolls of thin film (typically 25 micron PEN) are selected and a thin (typically 5 micron) crosslinking adhesive layer is printed onto one surface using a converted newspaper printing press. The film may be of other compositions such as Kapton™ or Mylar™; however, the PEN film has been discovered to offer unique advantages in speaker applications. Film thicknesses will be determined by the specific properties of the speaker, but will generally range from 10 to 50 microns. The thickness of the adhesive layer needs to be sufficient to ensure uniform contact and adhesion within the processed laminate which is being formed.

B. Thin aluminum foil (typically 17-25 micron), also in roll form, is bonded to the adhesive layer and re-wound into a roll of laminated film/foil material. The adhesive layer then goes through its crosslinking process to become fully cured. Other conductive materials such as copper may be used; however, the preferred material is aluminum in view of cost, thermal properties, general utility and density, as discussed above.

C. The roll of laminate is positioned as a feed roll in a conventional newspaper printing press, and a newspaper printing cylinder applies a PVC resist coat pattern to the foil side of the laminate as in the printing process. The specific pattern corresponds to the conductive elements represented in the figures as 31, 45, 53, 76 and 94. The printing method for attachment of the conductive elements is particularly beneficial because it allows virtually any circuit pattern to be laid on the film in an inexpensive manner.

D. The clear resist coat pattern is quickly dried and the laminate is immersed in a tank of a caustic soda solution where all the non-resist coated portions of the foil are etched away, leaving the aluminum circuit pattern intact and the thin adhesive layer that held the foil that was etched away is now exposed.

E. The film/pattern laminate is now rinsed to neutralize the etching process and dried.

F. Immersion in the etchant partially re-activates the exposed crosslinked adhesive layer so another very thin (typically 4-5 micron) sealing layer of the PVC resist coat can be printed onto the entire surface of the etched side of the film to prevent it from bonding to the opposite side of the film when re-wound on a roll. This resist layer further serves to protect the foil and dampen unwanted diaphragm resonances and standing waves that would otherwise contribute to distortion of the audio output.

The printing method for emplacement of the conductive circuit on the vibrating diaphragm provides significant advantages as part of a planar magnetic speaker. Whereas conductive wires were typically glued to the film, or conductive layers were bonded by a pressure laminating process using double adhesive transfer tape or other medium, the printed adhesive layer is thinner, lighter, and more thermally durable. This low mass and high thermal tolerance is critical to the optimum efficiency and reliability of the finished loudspeaker.

Other bonding techniques may be adaptable to the printing process; however, mechanical challenges may be cost prohibitive. For example, bonding foil to film using the film as the adhesive layer (aka "adhesiveless") is an alternative but the cost of the materials processed in this way is prohibitively expensive for use in an affordable loudspeaker product, especially when the loudspeaker is made sufficiently large to meet the demands of high output and wide bandwidth operation. Adhesiveless diaphragm/conductor assemblies for lower mass and much greater thermal capability could be implemented using polyamide with liquid polyamide interface, polyamide and melted polyamide on the foil, or case polyamide wherein the aluminum foil is activated with corona discharge and bonded to the polyamide film.

The laminating processes commonly known as vapor deposition or "sputtering" are similarly cost prohibitive and the deposit thickness is difficult to control when metals of this thickness are required. The more commonly available "photo-etching" process used to produce both flexible and rigid circuits is far more expensive than the process described above and typically uses copper as the metal foil. Copper has a poor conductivity-to-mass ratio compared to aluminum which would reduce the efficiency and output capabilities of the loudspeaker.

The printing method for applying the circuit to the film diaphragm in accordance with the preferred embodiment is represented by the following specifications for the process and resulting diaphragm:

A. The source film comprises PEN film, 25 microns thick, 25 inches wide, and in roll form.

B. Crosslinked polyurethane adhesive is printed in a layer 5 microns thick. Crosslinking is achieved with heat and is very fast to cure. High cure speed is needed to comply with high speed roll-to-roll processing.

C. Conductive foil comprises a soft alloy aluminum foil layer 17 microns thick.

D. The resist coat is printed onto aluminum in any desired conductor pattern.

E. Etching occurs in caustic soda solution. The solution is initially heated to enable etching; however, the etching process creates intense heat which requires that the solution be cooled to desired temperature. Temperature control, dilution of etchant and thru-put speed need constant monitoring and adjustment during a period of about 7-9 hours before final process settles in to the desired condition and is stabilized.

F. A release coat is then applied to the entire surface to insure that the exposed adhesive layer, where the aluminum has been removed during the etching process, is kept from sticking to the opposite side of the PEN when the material is rolled up. This configuration also improves tolerance to hostile environments and provides a surface which is covered by the resist coat and the release coat.

With the film properly printed with the desired conductive circuit pattern and otherwise prepared for application to the speaker frame as a speaker diaphragm, proper tensioning can be implemented as discussed above. The preferred method utilizes the unique heating shrink properties discovered as part of the present invention. Specifically, a method for shrinking a vibratable film for use with a bonded electrically conductive circuit disposed thereon without substantially affecting attachment configuration between the film and bonded circuit includes the following steps:

a) selecting a film of polyethylenenaphthalate having a thickness of less than 100 microns and having the conductive circuit disposed on a side of the film;

b) applying ultraviolet radiation at the side of the film having the conductive circuit; and c) maintaining the ultraviolet radiation for sufficient time to shrink dimensions of a portion of the film which is not bonded to the conductive circuit, without causing significant shrinkage of the film which is bonded to the conductive circuit, thereby preserving an integral and unwrinkled attachment configuration between the film and circuit.

A preferred thickness for the film is approximately 25 microns, with an adhesive layer of approximately 5 microns for bonding the aluminum as the conductive circuit. The aluminum may be in foil configuration with a thickness of between 17 to 25 microns. The ultraviolet radiation is maintained until the proper shrinkage occurs. The maximum amount of shrinkage for PEN is between 0.8 and 1.0%.

This same technique forms part of a method for permanently attaching a vibratable diaphragm with a desired tension as part of a planar magnetic speaker, including the steps of:

a) selecting a film of polyethylenenaphthalate having thickness of less than 100 microns and having the conductive circuit disposed on a side of the film;

b) positioning the film for attachment on a speaker support frame in tension;

c) permanently attaching the film at a periphery to the frame for use as a speaker diaphragm for the planar magnetic speaker;

d) applying ultraviolet radiation at the side of the film having the conductive circuit; and e) maintaining the ultraviolet radiation for sufficient time to shrink dimensions of a portion of the film which is not bonded to the conductive circuit to the desired tension, without causing significant shrinkage of the film which is bonded to the conductive circuit, thereby preserving an integral and unwrinkled attachment configuration between the film and circuit.

Although the present disclosure gives numerous examples of specific processes, it is to be understood that those skilled in the art will appreciate that such examples are merely representative in the invention embodied therein. Accordingly, it is to be understood that the invention is not be limited by the disclosure, but is represented more accurately in the following claims.

The invention claimed is:

1. A single-end planar magnetic loudspeaker system comprising:

at least one thin-film, flexible diaphragm having a front side and a rear side, configured for converting an input electrical signal into a corresponding acoustic output, said at least one diaphragm including a conductive material carried by the diaphragm in a predetermined conductive region and a predetermined non-conductive region and a total vibratable surface area of less than 150 sq inches;

at least one high energy magnetic structure of predetermined thickness positioned adjacent to said at least one thin-film, flexible diaphragm, adjacent one but not the other of the front side and the rear side of said diaphragm so as to provide a single-ended transducer configuration, and wherein the high energy magnetic structure is at least 0.060 inches in thickness and operable to provide a speaker sensitivity of at least 85 db at a power level of one watt;

and wherein said predetermined thickness does not exceed a thickness where at least a three dB increase in SPL is obtained over that which would be obtained in a structure of half said thickness, and is configured in up to seven rows of magnetic material, each of said rows having a cross sectional configuration wherein the width of the material is at least as great as the width thereof;

a mounting structure configured as part of the single end planar magnetic speaker and coupled to the diaphragm to capture the diaphragm, hold it in a predetermined state of tension and space it at a predetermined distance from the high energy magnetic structure, and, the system as thus configured being operable as a single end loudspeaker system.

2. A loudspeaker as defined in claim 1, wherein the high energy magnetic structure has an energy product of at least 40 MGO.

3. The planar magnetic loudspeaker system of claim 1 wherein damping is provided to mitigate unwanted diaphragm vibrations.

4. A loudspeaker as defined in claim 1, wherein the magnetic structure comprises neodymium.

5. A loudspeaker as defined in claim 1, wherein said thin film, vibratable diaphragm and high energy magnetic structure are cooperatively capable of generating acoustic output in at least a midrange and upper range of audio frequencies.

6. A speaker as defined in claim 1, wherein the conductive region includes a conductive foil bonded to the diaphragm to form a conductive circuit, the diaphragm and foil being bonded in one of two ways consisting of: a) being bonded directly without adhesive; and b) being bonded by an adhesive in a layer not more than five microns in thickness.

7. A planar magnetic loudspeaker comprising:

a diaphragm of thin, tensionable film including a conductive region and a non-conductive region;

a magnetic structure positioned adjacent and at a predetermined distance from said diaphragm for interaction with the conductive region of the diaphragm;

a collapsible speaker frame with a plurality of spring biased mounting arms for attachment of the diaphragm at the predetermined distance, said mounting arms having a first, static position at rest, and a second, tensioned position wherein a distance between the mounting arms in the tensioned position is less than a separation distance in the static position and corresponds to a predetermined tension to be applied to the diaphragm during use;

means for permanently attaching the diaphragm to the mounting arms of the speaker frame.

8. A single-end planar-magnetic electro-acoustic transducer, including:

a support structure;

a magnetic structure comprising high-energy magnet material arranged in up to seven rows, wherein each row has a crossectional shape wherein the width is at least as great as the height;

a diaphragm carried by the support structure, having a vibrateable surface area of less than 150 square inches;

a conductive element carried by and coupled to the diaphragm so that movement of the conductive element moves the diaphragm, positioned with respect to and cooperating with the magnetic structure so that when an appropriate electrical signal is passed through the conductive element, an acoustic output results;

the transducer being configured as a single end device and having a sensitivity of at least 85 db at one Watt in midrange and upper frequency ranges.

9. A transducer as set forth in claim 8, wherein the magnetic structure includes neodymium.

10. A transducer as set forth in claim 8, further including a material applied to the diaphragm to reduce unwanted vibration.

11. A transducer as set forth in claim 8, further comprising a material configured to absorb acoustic energy emitted so as to mitigate a resonant peak in response, said material carried by the support structure.

12. A loudspeaker as set forth in claim 8, the diaphragm comprising a material that is shrinkable by exposure to electromagnetic radiation, and having a conductive area where the conductive element is disposed and a non-conductive area where said element is not disposed, the diaphragm being shrunk more in the non-conductive area and less in the conductive area, at least a part of a tension force acting on the diaphragm being created by said shrinkage.

13. A single-end planar-magnetic loudspeaker, comprising:

a support structure formed primarily of a stamped plate comprising ferrous material;

a magnetic structure having up to seven rows of magnets carried by the support structure and cooperating therewith to produce magnetic fields, the magnetic structure including high energy magnets having an energy product of greater than 25 mega-gauss orsterads, said magnet rows being configured so that in cross section they are at least as wide as they are deep, and are less deep than a depth that when doubled would yield a 3 dB increase in loudspeaker sensitivity all other factors being unchanged, a spacing distance between said rows being at least as great as the depth of the magnetic structure;

a thin film, tensioned, diaphragm, carried by the support structure, and which has a composition that includes a polymeric material that can shrink when exposed to electromagnetic radiation; and, a conductive element, carried by and attached to the diaphragm at the conductive area so that movement of the conductive element moves said diaphragm, the conductive element being positioned in a magnetic field adjacent said magnetic structure, the loudspeaker being operable as a single-end planar-magnetic loudspeaker in at least the midrange and upper frequency ranges.

14. A loudspeaker as set forth in claim 13, having a vibratable diaphragm surface area of less than 150 square inches.

15. A single-end planar-magnetic electro-acoustic transducer, comprising:

a support structure;

a magnetic structure, carried by the support structure, configured to create magnetic fields;

a diaphragm comprising PEN material carried by the support structure having a conductive area and a non-conductive area;

a conductive element attached to the diaphragm over the conductive area, and positioned within said magnetic fields, configured to cooperate with the magnetic structure to produce forces on the diaphragm when an appropriate electrical signal is passed through the conductive element, whereby an acoustic output is facilitated;

wherein the support structure comprises a ferrous material and is configured to enhance the strength of the magnetic fields provided by the magnetic structure, and wherein the magnetic structure comprises a high-energy magnetic material, having an energy product of greater than 25 MGO and comprising neodymium, and wherein the conductive element comprises a conductive material having a high conductivity per volume weight and includes aluminum.

16. A transducer as set forth in claim 15, wherein the diaphragm further comprises an applied material which mitigates unwanted vibrations and distortion.

17. A transducer as set forth in claim 16, further comprising an energy dissipating material configured for mitigation of a resonant peak in transducer response.

18. A single-end planar-magnetic electro-acoustic transducer, comprising a support structure a high-energy magnetic structure carried by the support structure a tensioned thin-film diaphragm, carried by the support structure, the diaphragm being damped to mitigate unwanted vibration, facilitating improved fidelity of sound reproduction;

a conductive element carried by and attached to the diaphragm;

the forgoing cooperating so that when an appropriate electrical signal is sent through the conductive element forces are created acting through the conductive element on the diaphragm, causing movement of the diaphragm which results in an acoustic output;

wherein the diaphragm has material applied thereon which facilitates damping of the diaphragm.

19. A transducer as set forth in claim 18, wherein the diaphragm has material applied thereon which facilitates damping of the diaphragm.

* * * * *